US006682824B1

(12) United States Patent
Koshiba et al.

(10) Patent No.: US 6,682,824 B1
(45) Date of Patent: Jan. 27, 2004

(54) ADHESION-RESISTANT OXYGEN-FREE ROUGHLY DRAWN COPPER WIRE AND METHOD AND APPARATUS FOR MAKING THE SAME

(75) Inventors: Yutaka Koshiba, Tokyo (JP); Tutomu Masui, Osaka (JP); Kazumasa Hori, Osaka (JP); Yoshiaki Hattori, Osaka (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/832,191

(22) Filed: Apr. 11, 2001

(30) Foreign Application Priority Data

Apr. 11, 2000 (JP) ..... 2000-109828

(51) Int. Cl.[7] ..... C23C 9/00; C22B 1/00
(52) U.S. Cl. ..... 428/469; 252/512; 252/518.1
(58) Field of Search ..... 428/469; 252/512, 252/518.1

(56) References Cited

U.S. PATENT DOCUMENTS 5,798,008 A 8/1998 Nogami et al.

FOREIGN PATENT DOCUMENTS

| | | | | |
|---|---|---|---|---|
| DE | 27 46 612 | | 4/1979 | |
| EP | 0 440 184 | | 8/1991 | |
| GB | 2 041 411 | | 9/1980 | |
| JP | 74-29382 | * | 8/1974 | ..... H01P/00/00 |
| JP | 53-46426 | * | 4/1978 | ..... C22B/1/10 |
| JP | 55-104462 | * | 8/1980 | ..... C22F/1/08 |
| JP | 62-70541 | | 4/1987 | |
| JP | 62-93325 | | 4/1987 | |
| JP | 64-68908 | * | 3/1989 | ..... H01F/5/08 |
| JP | 7-242965 | | 9/1995 | |
| JP | 10-17956 | | 1/1998 | |
| WO | WO99/46415 | | 9/1999 | |

OTHER PUBLICATIONS

Patent Abstracts of Japan, JP 4–099234, Mar. 31, 1992.
Derwent Publications, AN 1987–139805, XP–002199580, JP 62–078861, Apr. 11, 1987.
Derwent Publications, AN 1976–71422X, XP–002199581, JP 51–089861, Aug. 6, 1976.
Derwent Publications, AN 1987–288634, XP–002199582, JP 62–202065, Sep. 5, 1987.

* cited by examiner

*Primary Examiner*—Cathy Lam
*Assistant Examiner*—Vivek Koppikar
(74) *Attorney, Agent, or Firm*—Oblon, Spivak, McClelland, Maier & Neustadt, P.C.

(57) ABSTRACT

An adhesion-resistant oxygen-free roughly drawn copper wire having an oxygen concentration of 1 to 10 ppm and a hydrogen concentration of 1 ppm or less, has a surface oxide film having a total thickness of 50 to 500 angstroms, in which 0.2 to 90% of the total thickness of the oxide film is $Cu_2O$. The adhesion-resistant oxygen-free roughly drawn copper wire is prepared using a continuous casting process, in which the molten copper is agitated and dehydrogenated in a casting trough containing weirs, and the thickness of the oxide layer is controlled by alcohol cleaning the cast copper bar material prior to rolling.

7 Claims, 5 Drawing Sheets

ROX -OF

DIP

ADHESION-RESISTANT OXYGEN-FREE ROUGHLY DRAWN COPPER WIRE AND METHOD AND APPARATUS FOR MAKING THE SAME

BACKGROUND OF THE INVENTION

1. Field of the Invention

The present invention is an adhesion-resistant oxygen-free roughly drawn copper wire, and a method and apparatus for making the same. Oxygen-free roughly drawn wire is preferably used, for example, to make wire used in electronic devices, such as a lead wire, a winding, a linear electrical component, and wire used for communications and electrical power transmission.

2. Description of the Related Art

Low-oxygen copper wires produced by conventional processes tend to adhere to themselves, thereby reducing the quality of the wire and hindering subsequent processing steps. Wire produced, for example by the SCR method, do not adhere to one another, but are not oxygen-free. Thus, it is difficult to manufacture oxygen-free roughly drawn wire which does not adhere to itself because the processing conditions which provide for low oxygen levels in the copper wire also tend to promote the adhesion of the oxygen-free wire with itself.

SUMMARY OF THE INVENTION

The present invention is an adhesion-resistant oxygen-free roughly drawn copper wire, and a method and apparatus for mass producing it at low cost. The adhesion-resistant oxygen-free roughly drawn copper wire of the present invention has an oxygen concentration of 1 to 10 ppm, a hydrogen concentration of 1 ppm or less, and has a surface oxide film having a total thickness of 50 to 500 angstroms, in which at least part of the oxide film is composed of $Cu_2O$.

BRIEF DESCRIPTION OF THE DRAWINGS

FIG. 4*a* shows a horizontal cross-section and FIG. 4*b* shows a side cross-section.

DETAILED DESCRIPTION OF THE INVENTION

The term "roughly drawn wire" refers to a wire, usually having a wire diameter of 5 mm to 30 mm, before it is subjected to a drawing process in which the diameter of the wire is reduced, and the round cross-sectional shape is produced.

Dip forming is a conventional method for producing low-oxygen copper wire, in which a seed copper wire is passed through a vessel containing molten copper. The molten copper sticks to the seed wire, thereby producing a bar copper material, which is then rolled into the form of a wire. Low oxygen roughly drawn copper wire can be continuously produced from molten copper using the dip forming method, with a production line arranged in series. Low-oxygen or oxygen-free roughly drawn copper wire may also be prepared by extruding a low-oxygen or oxygen-free copper billet.

Oxygen-free copper wire is copper wire that contains 1–10 ppm of oxygen in the copper phase. Low-oxygen copper wire is wire that contains less than 20 ppm of oxygen in the copper phase.

Figure 5:
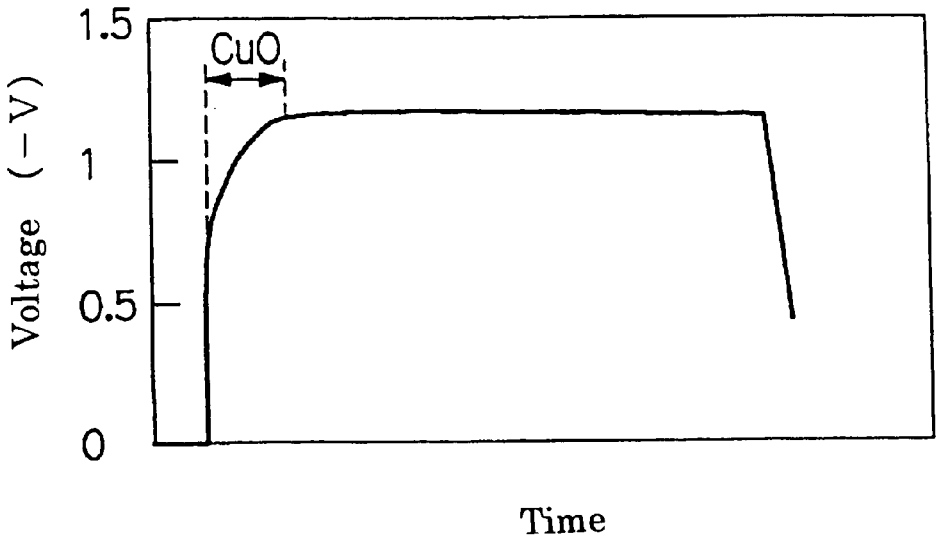
FIG. 5 is a plot of a potentiometric titration analysis of an oxide film of a roughly drawn copper wire produced by a conventional dip forming method.

When low oxygen roughly drawn copper wire is produced by the dip forming method, then subjected to wire drawing, bobbin winding, and vacuum pot annealing, the resulting wires tend to adhere to each other. Because much of the dip forming method is performed in an oxygen-free atmosphere, it is believed that this self-adhesion phenomenon is due to the presence of a thin oxide film (i.e., a film thickness of 50 angstroms or less) on the surface of the wire, which does not contain $Cu_2O$. For example, FIG. 5 is a plot of the potentiometric titration of the oxide film of a roughly drawn copper wire produced by the dip forming method. As is clear from FIG. 5, this oxide film is composed only of CuO, and does not contain observable amounts of $Cu_2O$.

If the thickness of the oxide film was increased, for example by introducing oxygen during the casting step of the dip forming process (i.e., by allowing air into the casting system), the increase in the thickness of the oxide film was accompanied by various problems. For example, the copper produced when air was introduced into the casting system was not oxygen-free. If air was instead introduced into the hood extending from the casting system to the rolling mill, it was again likely that oxygen would be able to enter the casting system and contaminate the copper, because it is structurally difficult to completely seal the casting system from the hood. Likewise, introducing air into the atmosphere of the rolling mill, also tends to contaminate the atmosphere of other parts of the process. Thus, introducing air into the casting system or to the hood of the rolling mill tends to introduce oxygen into the copper wire, thereby preventing the production of oxygen-free copper wire.

Moreover, even when it was possible to make oxygen-free copper wire having an oxide film containing $Cu_2O$ by introducing air into the hood of the rolling mill, it was very difficult to control the composition and thickness of the oxide film.

In addition, when the hydrogen content of the reducing atmosphere of various processing steps is as high as 1 ppm or more, for example in heat treatments such as batch annealing, self-adhered wires and surface flaws in the wire were observed.

As discussed above, oxygen-free copper wire may also be produced by extruding a billet of oxygen-free copper. However, this process requires two steps: casting the billet and extruding the billet, and is consequently more costly than the dip forming method.

Low-oxygen copper wire or oxygen-free roughly drawn copper wire may also be made by a continuous casting process using a belt caster type continuous casting machine.

Such processes and machines are described, for example, in Japanese Examined Patent Application Publication No. 59-6736 and Japanese Unexamined Patent Application Publication No. 55-126353, herein incorporated by reference. For example, belt caster type continuous casting machines consist primarily of a circulating endless belt and a rotating casting wheel, in which a part of the circumference of the casting wheel contacts the endless belt, or alternatively, a machine composed of two circulating endless belts. The continuous casting machine is attached to a large melting furnace (e.g., a shaft furnace), and a rolling mill, so as to produce copper wires at high speed by continuously casting casting and rolling the molten copper from the melting furnace. Such processes are highly productive and make possible mass production of the copper wire, and thereby reduce the production costs of making copper wire.

In such belt caster type continuous casting machines, low-oxygen copper wire is produced by casting and rolling the low-oxygen molten copper produced under reducing conditions, using a reducing gas and/or an inert gas while transferring the molten copper to successive processing steps. However, even when deoxygenated molten copper was produced in the melting furnace and transferred under airtight conditions using a reducing gas and/or an inert gas atmosphere, holes were generated in the cast copper material and flaws were generated on the wire surface during rolling, thereby degrading the quality of the surface. Accordingly, until now it has not been possible to produce commercial quality low-oxygen copper wire using a continuous belt caster type casting machine, but instead it has been primarily produced by the above-described dip forming method.

It is believed that the holes in the cast copper wire are due to $H_2O$ generated by the reaction of hydrogen and oxygen in the molten copper, as well as hydrogen and oxygen gas released from the molten copper during solidification, because these gases become less soluble in the copper as it solidifies. During solidification, the $H_2O$, oxygen and/or hydrogen gases form bubbles in the copper, which are trapped upon cooling so as to form holes or flaws in the wire during the rolling step.

The thermodynamic relationship between the concentrations of hydrogen (e.g., hydrogen derived from fuel gases) and oxygen in the molten copper is represented by the following formula (A), $$[H]^2[O]=p_{H2O}\times K \qquad \text{Formula (A)}$$

where [H] represents the concentration of hydrogen in the molten copper, [O] represents the concentration of oxygen in the molten copper, $p_{H2O}$ indicates the partial pressure of steam in the atmosphere above the molten copper, and K is an equilibrium constant. Since the equilibrium constant is a function of temperature, and is therefore constant when the temperature is constant, the concentrations of oxygen and hydrogen in the molten copper are in inversely proportion to each other, assuming a constant partial pressure of steam. Thus, the concentration of hydrogen in the molten copper increases when the concentration of oxygen is decreased by the reducing atmosphere, so that holes due to dissolved hydrogen are likely to form during solidification of the molten copper. The resulting low-oxygen copper wire then has many flaws and inferior surface quality. In other words, we have found that in addition to reducing the oxygen concentration, it is also necessary to reduce the hydrogen concentration in the copper in order to produce low-oxygen copper wire which does not form holes during solidification of the copper, and therefore has good surface quality.

While it may be possible to produce molten copper having a low concentration of hydrogen by completely combusting the hydrogen, using the conventional oxidation-reduction degassing method, this method is not practical in a process using a belt caster type machine, because long transfer distances are required for subsequent deoxidation of the molten copper.

However, if the oxygen-free roughly drawn copper wire contains 1 to 10 ppm of oxygen and 1 ppm or less of hydrogen, the release of gases from the copper during casting is reduced and the resulting formation of holes in the bar copper material is suppressed, thereby decreasing flaws in the ultimate wire surface.

The oxygen-free roughly drawn copper wire should have a total oxide film thickness of 50 to 500 angstroms, preferably 150 to 500 angstroms, more preferably 250 to 500 angstroms. At least a part of the total oxide film thickness on the copper should be composed of $Cu_2O$, so that oxygen-free copper wires produced therefrom do not self-adhere. The presence of the $Cu_2O$ in the oxide film is essential to preventing the copper wires from adhering to each other.

It is known that self-adhesion of oxygen-free roughly drawn copper wires occurs when the copper wires have an oxide film composed only of CuO. However, the oxygen-free roughly drawn copper wires of the present invention are not self-adherent because they have oxide films composed of layers of $Cu_2O$ and CuO, in that order, from the surface of the copper core outwards. See, for example, FIG. 1, in which the copper core is surrounded by concentric layers of $Cu_2O$ and CuO. In addition, the $Cu_2O$ and CuO oxide films should not form a clear boundary in the oxide film. On the contrary, it is believed that self-adhesion of the copper wire is prevented when some of the $Cu_2O$ oxide intrudes into the CuO oxide.

In addition to this oxide structure, it is also believed that the low concentration of hydrogen in the copper is involved in preventing adhesion. That is, since hydrogen has a large diffusion coefficient in the copper, when hydrogen ions in copper are activated by heat treatment, for example, by annealing, the hydrogen ions diffuse rapidly between wires at the points of contact, and therefore the hydrogen ions diffuse between the copper wires at the points of contact, thereby causing adhesion. Therefore, the concentration of hydrogen in the copper should be 1 ppm or less in order to prevent adhesion between the copper wires.

The thickness of the above-discussed $Cu_2O$ oxide film is preferably 0.2 to 90% of the total thickness of the oxide film of the adhesion-resistant oxygen-free roughly drawn copper wire of the present invention. More preferably, the $Cu_2O$ oxide film is 1 to 50% of the total thickness of the oxide film. When the thickness of the $Cu_2O$ oxide film is less than 0.2% of the total thickness of the oxide film, self-adhesion of the copper wires is likely to occur for the reasons discussed above. That is, hydrogen ions can readily diffuse between the copper wires, thereby causing adhesion. When the $Cu_2O$ oxide film exceeds 90% of the total thickness of the oxide film, various copper powders are generated during the wire drawing step, which cause breaks in the wire and severe abrasion of the die.

Figure 6:
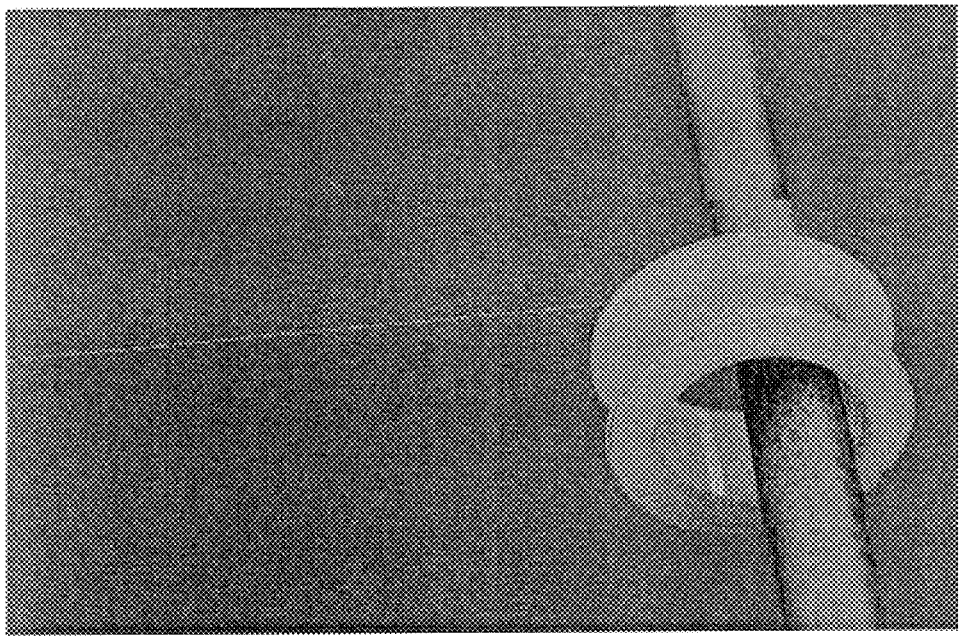
FIG. 6 is a photograph of roughly drawn copper wire containing 5 ppm oxygen and 0.5 ppm hydrogen, and having a total oxide layer thickness of 247Å, and a $Cu_2O$ layer thickness of 23Å.
Figure 7:
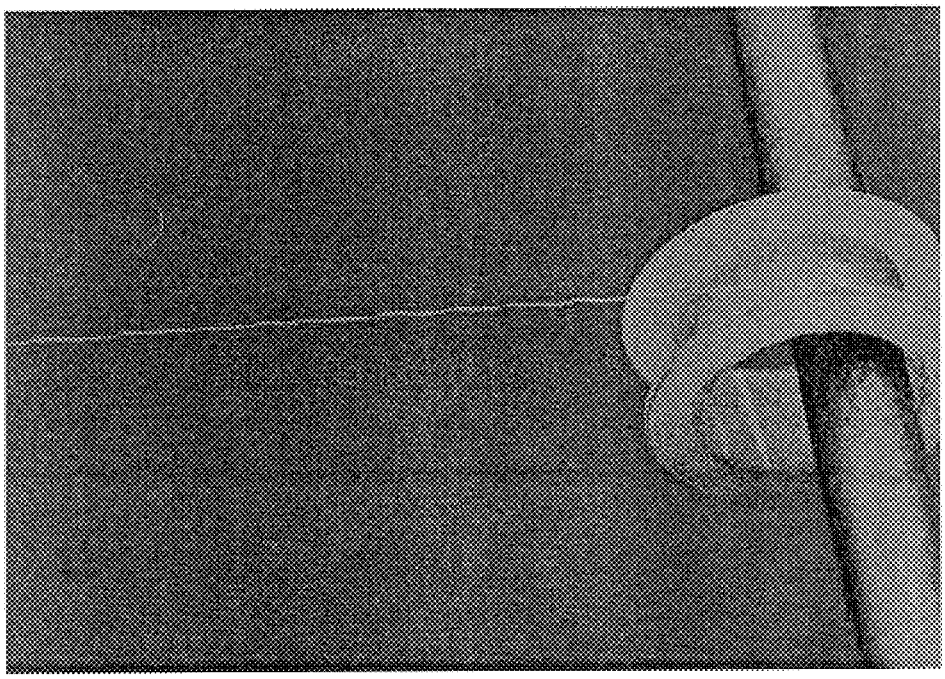
FIG. 7 is a photograph of a warped roughly drawn copper wire containing 10 ppm oxygen and 1.1 ppm hydrogen, and having a total oxide layer thickness of 30Å, and no $Cu_2O$ layer.

When the oxygen-free roughly drawn copper wire has the above-described levels of oxygen and hydrogen, and is produced with a belt caster type continuous casting machine, long lengths of adhesion-resistant oxygen-free roughly drawn copper wire may be continuously produced at low cost. See, for example, FIGS. 6 and 7, which compares roughly drawn copper wire prepared according to the present invention (i.e., FIG. 6), and warped roughly drawn copper wire prepared without a $Cu_2O$ layer, and having a hydrogen concentration of 1.1 ppm (i.e., FIG. 7).

Preferred embodiments of the adhesion-resistant oxygen-free roughly drawn copper wire of the present invention, a manufacturing method therefor, and a manufacturing apparatus therefor according to the present invention will be described below, in details with reference to the drawings.

Figure 1:
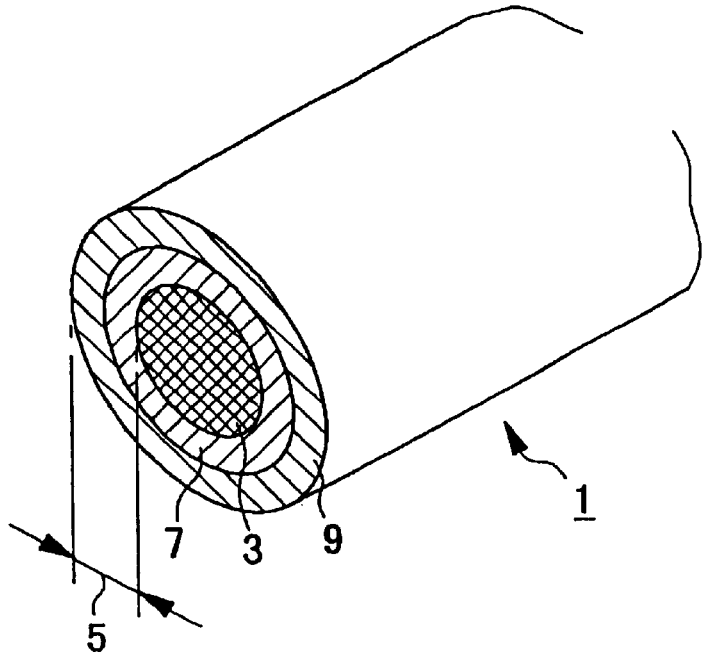
FIG. 1 is a cross-sectional view of an adhesion-resistant oxygen-free roughly drawn copper wire according to the present invention.

FIG. 1 is a cross-sectional view of an adhesion-resistant oxygen-free roughly drawn copper wire 1 of the present invention, having a copper core wire 3 which contains 1 to 10 ppm of oxygen and 1 ppm or less of hydrogen, and an oxide film 5 having a total thickness of 5 to 500 angstroms. The oxide film 5 comprises a $Cu_2O$ oxide film 7 and a CuO oxide film 9, where the $Cu_2O$ oxide film 7 is formed underneath the CuO oxide film 9. The $Cu_2O$ oxide film and the CuO oxide film of do not, however, form a clear boundary interface. On the contrary, it is believed that some of the $Cu_2O$ oxide film 7 intrudes into the CuO oxide film 9.

Figure 2:
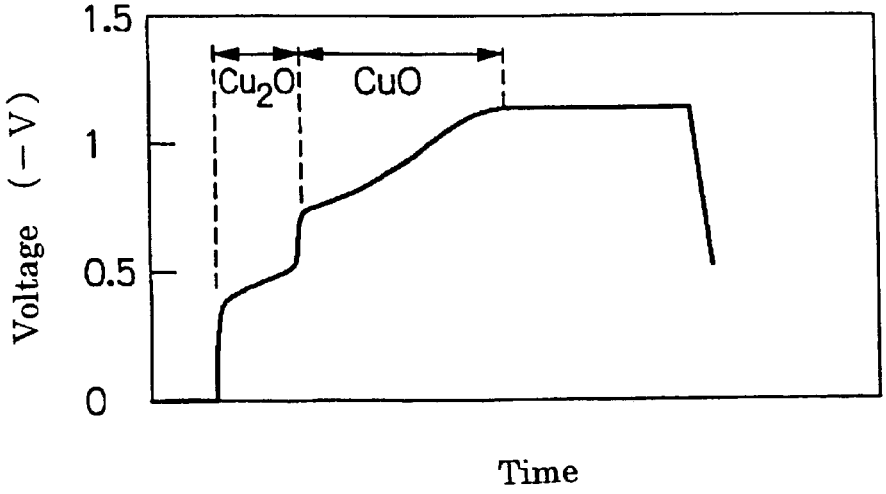
FIG. 2 is a plot of a potentiometric titration analysis of the oxide film of a roughly drawn oxygen-free copper wire of the present invention.

FIG. 2 shows the results of an analysis by potentiometric titration of the oxide film 5 of a roughly drawn oxygen-free copper wire produced by a method of the present invention. FIG. 2 clearly shows that the oxide film 5 is composed of both an outer layer of CuO and an inner layer of $Cu_2O$.

Based on practical experience in handling the adhesion-resistant oxygen-free roughly drawn copper wire of the present invention, it is clear that when the thickness of the $Cu_2O$ oxide film is within the range 0.2 to 90% of the total thickness of the oxide film 5, the oxygen-free roughly drawn copper wires exhibit remarkably reduced adhesion.

It was also discovered that the adhesion-resistant oxygen-free roughly drawn copper wire 1 had remarkably improved adhesion resistance and surface quality when the concentration of oxygen and hydrogen in the copper were reduced, and the thickness of the $Cu_2O$ oxide film was maintained at the aforementioned ranges. That is, when the concentration of oxygen in the copper is less than 1 ppm, the concentration of hydrogen in the copper increases so that dehydrogenation of the copper becomes difficult. In addition, when the concentration of hydrogen increases, many blowholes were formed in the bar copper material, thereby generating flaws which degrade the surface quality of the wire. On the other hand, when the concentration of oxygen is 10 ppm or more, hydrogen embrittlement of the copper may occur. Thus, the concentration of oxygen in the copper should be 1 to 10 ppm, preferably 1 to 8 ppm.

When the concentration of hydrogen is 1 ppm or more, the wires are likely to adhere to each other. As discussed above, since hydrogen has a large diffusion coefficient in the copper wire, when the wire is heat treated, for example, by annealing, the hydrogen ions diffuse rapidly between the copper wires at the points of contact, thereby causing adhesion. However, copper having an oxygen concentration of 1 to 10 ppm and a hydrogen concentration of 1 ppm or less, preferably 0.5 ppm or less, more preferably 0.2 ppm or less, decreases the amount of released gas during casting, suppressing the generation of holes in the bar copper, and thereby decreasing flaws on the wire surface produced therefrom.

Figure 3:
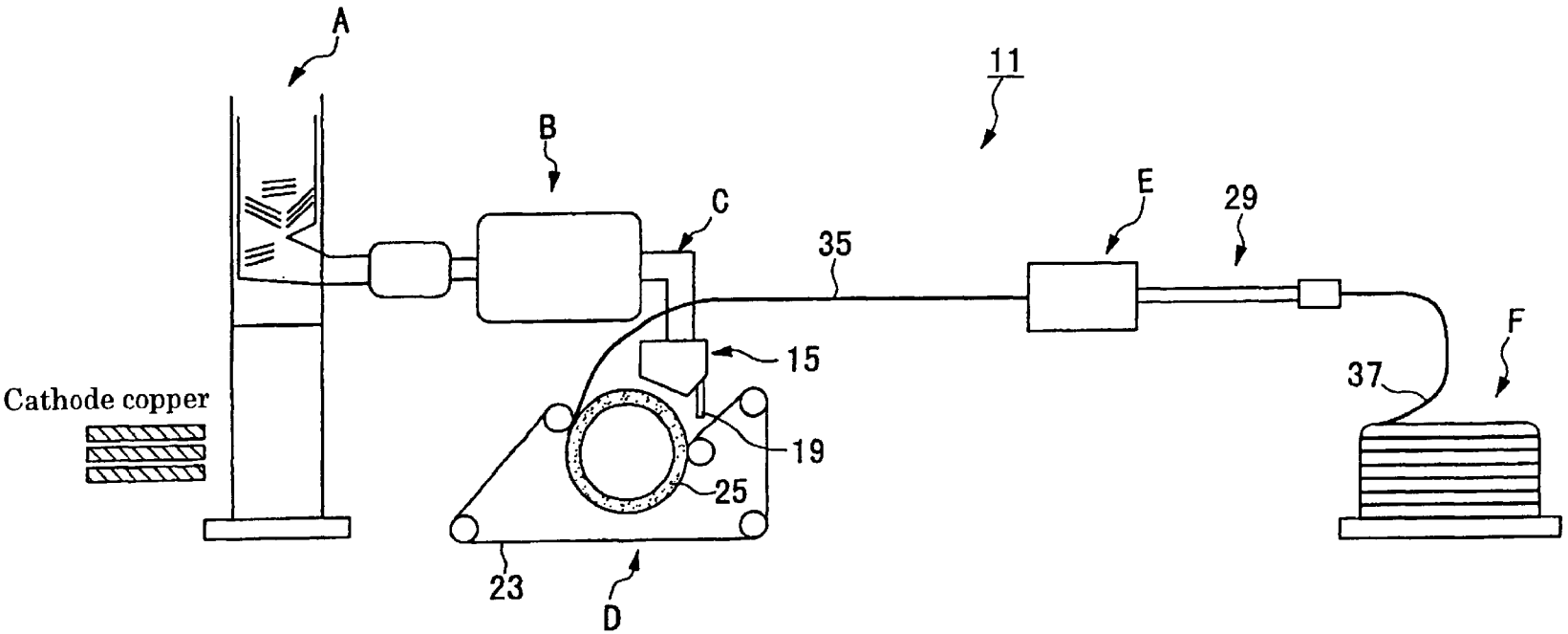
FIG. 3 is a diagram schematically showing the configuration of an apparatus for preparing the adhesion-resistant oxygen-free roughly drawn copper of the present invention.
Figure 4:
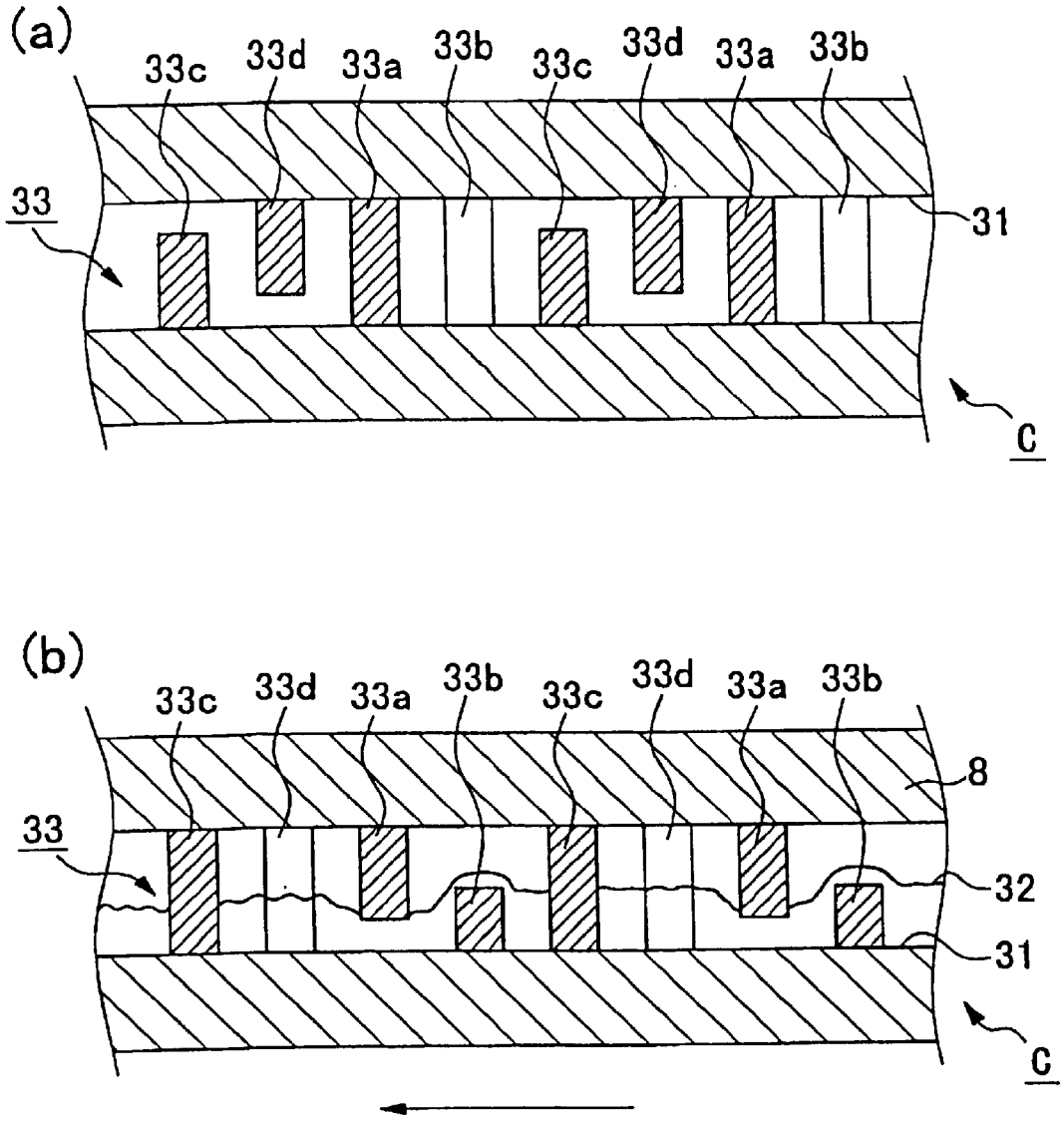
FIGS. 4*a* and 4*b* are cross-sectional views of a casting trough as shown in FIG. 3.

FIG. 3 is a diagram schematically showing the configuration of an apparatus for manufacturing an adhesion-resistant oxygen-free roughly drawn copper wire according to the present invention. FIGS. 4*a* and 4*b* are diagrams illustrating a casting trough as shown in FIG. 3. FIG. 4*a* is a cross-section of the casting trough C, viewed from the top of the trough, and FIG. 4*b* is a side cross-section view of the casting trough C.

As shown in FIG. 3, an apparatus 11 for manufacturing an adhesion-resistant oxygen-free roughly drawn copper wire according to the present embodiment of the present invention is primarily composed of a melting furnace A, a holding furnace B, a casting trough C, a continuous casting machine D, a rolling mill E and a coiler F.

Any type of copper melting furnace may be used in the apparatus of the present invention. For example, the melting furnace A is preferably, for example, a shaft furnace having a cylindrical furnace body. At the lower part of the melting furnace A, although not shown in the drawing, a plurality of multistage burners are arranged circumferentially. Combustion is performed in a reducing atmosphere in melting furnace A so as to produce molten copper. The reducing atmosphere is produced, for example, by increasing the amount of fuel in the burners so that the fuel/air ratio increases, and there is a higher equivalent amount of fuel compared to oxidant. The fuel may be, for example, natural gas, propane, or any other combustible hydrocarbon, preferably natural gas.

Before being discharged from the copper melting furnace, the molten copper contains less than 50 ppm of oxygen, preferable less than 30 ppm of oxygen, more preferably less than 20 ppm of oxygen.

The purpose of the holding furnace B is to transfer the molten copper from the melting furnace A to the casting trough C while maintaining the molten copper at a predetermined temperature. The holding furnace B maintains the molten copper discharged from the copper melting furnace A at a temperature range of from 1150 to 1300° C.

The molten copper in the holding furnace is maintained under the reducing atmosphere produced, for example, by increasing the amount of fuel in the burners, similar to the method of producing a reducing atmosphere described above for the melting furnace A. Descriptions of melting and holding furnaces suitable for forming the roughly drawn copper wire of the present invention are also found in U.S. Pat. Nos. 5,293,924 and 4,290,823, herein incorporated by reference.

As shown in FIG. 4*b*, the casting trough C consists of a trough having a bottom 31*c* and top 8, and as shown in FIG. 4*a*, sides 31*a* and 31*b* defining a cavity 31, which is the copper flow path. Cover 8 provides a gas-tight seal to seal in an oxygen-free atmosphere over the surface of the molten copper being transferred from the holding furnace B to a tundish 15. This oxygen-free atmosphere is formed, for example, by blowing inert gases, such as a mixed gas of argon, nitrogen, or carbon monoxide into the casting trough C, over the surface of the molten copper 32, as shown in FIG. 4*b*.

As it flows through the casting trough C, the molten copper is intensely agitated by means of weirs 33*a*, 33*b*, 33*c*, and 33*d*, in order to improve contact between the oxygen-free atmosphere (i.e., inert gas), and the molten copper. Because the partial pressure of hydrogen in the oxygen-free atmosphere of the casting trough is much lower than that of the molten copper, the hydrogen diffuses from the molten copper into the oxygen-free atmosphere, thereby dehydrogenating the molten copper.

The weirs 33*a* are affixed to the cover 8 of the casting trough. The weirs 33*b*, weirs 33*c*, and weirs 33*d* are affixed to the bottom 31*c*, the left side 31*b*, and the right side 31*a*, respectively, of the casting trough C. The molten metal is intensely agitated by being pushed up and down and from side to side by the weirs 33*a*, 33*b*, 33*c*, and 33*d*, in the direction of the arrow shown in FIG. 4*b*. In other words, the molten copper is automatically agitated by the flow of the molten copper itself against the weirs. This agitation increases the surface area of contact of the molten copper flowing through the casting trough with the oxygen-free atmosphere, which further increases the efficiency of the dehydrogenation. In addition, a plurality of weirs may be provided in the direction of the flow of the molten copper and/or a direction orthogonal to the flow of the molten copper.

In order to increase the amount of agitation, or in the case where longer casting troughs are used, a larger number or weirs 33*c* and 33*d* may be attached to the side of the casting trough, preferably 2 to 5 each of weirs 33*c* and 33*d*. In addition, a larger number of weirs 33*a* and 33*b* may be attached to the top and bottom of the casting trough, preferably 2 to 5 each of weirs 33*a* and 33*b*.

The weirs 33*c* and 33*d* increase the path length of the molten copper flow compared to the path length of the molten copper flow in the absence of the weirs. This increased path length increases the efficiency of the degassing treatment, even when the casting trough is short. Furthermore, the weirs 33*a* and 33*b* prevent the molten copper, either before or after being degassed, from being exposed and mixed with the atmosphere outside the casting trough (e.g., with air). The length of the casting trough C is preferably 2 to 5 m.

The primary purpose of the agitating device 33 is to dehydrogenate the molten copper, although it may also assist in removing any additional oxygen remaining in the molten copper. That is, the degassing which occurs in the casting trough is both a dehydrogenation treatment and a second deoxygenation treatment. When the weirs 33*a*, 33*b*, 33*c*, and 33*d* are made of carbon, the molten copper may be further deoxygenated due to contact of the oxygen in the molten copper with the carbon. Since the molten copper is both deoxygenated and dehydrogenated in the casting trough, the amount of gas released from the copper during casting decreases, thereby suppressing the generation of holes in the cast copper material, and ultimately, the number of flaws on the wire surface.

The end of the tundish 15 is provided with molten metal pouring nozzle 19, in the direction of flow of the molten metal, so that the molten copper from the tundish 15 may be supplied to the continuous casting machine D. Any type of continuous casting machine may be used. For example, as shown in FIG. 3, the continuous casting machine D may have a circulating endless belt 23 and a rotating casting wheel 25, in which a part of the circumference of the casting wheel 25 contacts the endless belt 23. The molten copper which exits the pouring nozzle 19 contacts the rotating casting wheel where it cools and solidifies, before being transported by the endless belt 23 to the rolling mill E.

The apparatus of the present invention is also provided with an alcohol cleaning device 29, located at an appropriate point between the rolling mill E and the coiler F. In this alcohol cleaning device 29, the bar copper material 35 produced from the continuous casting machine D and rolled with the rolling mill E is reduced by alcohol cleaning. The thickness of the $Cu_2O$ oxide film can be controlled by adjusting the extent of the alcohol cleaning.

The alcohol cleaning device cleans the bar copper material 35 by contacting the bar copper material with a solution comprising at least one alcohol. Any suitable means for contacting the bar copper material with the alcohol solution may be used. For example, the bar copper material may be passed through a tube filled with the alcohol, the alcohol solution may be sprayed onto the copper bar as it passes through the alcohol cleaning device, or the bar copper may be passed over a brush saturated with the alcohol solution. The temperature of the bar copper as it contacts the alcohol solution may be 450 to 750° C., preferably 500 to 700° C., more preferably 550 to 650° C. The temperature of the alcohol solution is 20 to 70° C., preferably 30 to 60° C., more preferably 40 to 50° C. In addition, the contact time between the copper bar material and the alcohol solution is 0.5 to 20 seconds, preferably 1 to 15 seconds.

Any alcohol may be used in the alcohol cleaning device of the present invention. The preferred alcohol is isopropanol (IPA). In addition, the cleaning solution used in the cleaning device 29 may also include acids. However, alcohols are preferred because they are easier handle and dispose of compared to acids.

As described above, and as shown in FIG. 3, the temperature of the molten copper transferred from the melting furnace A to the holding furnace B is increased and supplied to the continuous casting machine D by way of the casting trough C and the tundish 15. The molten copper is continuously cast in the continuous casting machine D and then formed into copper bar material 35 at the outlet of the continuous casting machine D. This bar copper material 35 is rolled in rolling mill E and then cleaned with alcohol in the alcohol cleaning device 29, thereby forming a roughly drawn copper wire 37 capable of being processed into an adhesion-resistant oxygen-free roughly drawn copper wire, and thereafter is wound around the coiler F.

With regard to the belt caster type continuous casting machine D, a holding furnace B must be provided in order to store the molten copper and to raise its temperature. The degassing treatment described above should be performed during the transfer of the molten copper from the holding furnace B to the tundish, through the casting trough C, because the deoxidation carried out in the holding furnace B to produce low-oxygen copper, either by combustion of the residual oxygen in a reducing atmosphere or deoxidation of the copper with a reducing agent, increases the concentration of hydrogen in the molten copper, based on the equilibrium relationship represented by formula (A).

It is preferable that the degassing step be carried out in the casting trough C, rather than in the tundish 15 prior to casting, because if the degassing is carried out in the tundish, the intense agitation of the molten metal, for example, by bubbling an inert gas through the molten copper, vibrates the surface of the molten metal, thereby causing the head pressure of the molten metal discharged from the molten metal pouring nozzle 19 to fluctuate. As a result, the molten copper is supplied to the continuous casting machine D unevenly. Moreover, if the molten copper is not agitated during the degassing process, in order to reduce the head pressure fluctuations at the molten metal pouring nozzle, the molten copper will be insufficiently degassed. Therefore, the molten copper is preferably degassed in the casting trough C, instead of in the tundish 15.

In addition, an electric furnace may be provided between the holding furnace B and the tundish 15 in order to stabilize the temperature of the molten copper.

A method for manufacturing adhesion-resistant oxygen-free roughly drawn copper wire 1 using the manufacturing apparatus 11 of FIG. 3 is described as follows.

First, combustion is carried out in a reducing atmosphere (i.e., excess natural gas provided by a high fuel/air ratio) in melting furnace A in order to deoxidize the molten copper. The molten copper is then discharged to holding furnace B. Since the concentrations of oxygen and hydrogen in the molten copper are inversely proportional to each other (i.e., based on formula (A)), the concentration of hydrogen in the deoxygenated molten copper in melting furnace A increases as the copper is deoxygenated. The deoxygenated molten copper is then discharged from the holding furnace B through casting trough C, under an oxygen-free atmosphere, in order to degas the molten copper (i.e., remove hydrogen) by agitating the molten copper with device 33 in the presence of an inert gas. The oxygen concentration of the molten copper in the melting furnace is thereby controlled to be 20 ppm or less and the hydrogen concentration of the molten copper in the melting furnace is controlled to be 1 ppm or less. As described above, the oxygen and hydrogen concentrations in the molten copper are further reduced in the casting trough.

By casting and rolling molten copper having 10 ppm or less of oxygen and 1 ppm or less of hydrogen, as described above, the release of gases during casting is reduced and consequently generation of holes in the cast copper material 35 is suppressed, thereby decreasing the number of flaws on the wire surface. Consequently, roughly drawn copper wire 37 having excellent surface quality can be produced.

The concentrations of gases in the molten copper may also be decreased by decreasing the partial pressure of steam, $p_{H2O}$ of formula (A), formed by the reaction of hydrogen and oxygen in the molten copper. Therefore, further degassing can be provided by completely separating the molten copper before dehydrogenation, from the dehydrogenated molten copper. This separation may be achieved, for example, by means of the agitating device 33 in the casting trough C. In other words, the agitating device 33 also functions to prevent the mixing of the oxygen-free gases in the casting trough, before and after the dehydrogenation, and the mixing of the molten copper before and after the dehydrogenation.

The method described above, for manufacturing adhesion-resistant oxygen-free roughly drawn copper wire reduces the concentration of hydrogen in the molten copper before casting, thereby suppressing the generation of holes during solidification of the molten copper. In addition, the thickness of the $Cu_2O$ oxide film can also be easily controlled by adjusting the amount of alcohol cleaning applied to the bar copper material 35 so that the suppression of adhesion of the wires to each other can be optimized. Finally, since the claimed method and apparatus allows the manufacture of adhesion-resistant oxygen-free roughly drawn copper wire on a continuous casting machine, for example, of a belt caster type continuous casting machine, long coil lengths of adhesion-resistant oxygen-free roughly drawn copper wire can now be mass-produced at low cost. Furthermore, such wires have a total oxide film thickness of 50 to 500 angstroms, containing $Cu_2O$, and are not self-adherent even when heat treated (e.g., batch annealing) in an oxygen-free atmosphere.

The priority document of the present application, Japanese patent application 2000-109828 filed Apr. 11, 2000, is incorporated herein by reference.

What is claimed as new and is intended to be secured by Letters Patent is:

1. A roughly drawn copper wire, comprising a copper core, and an oxide layer comprising a cuprous oxide layer, wherein the oxide layer has a total thickness of 50 to 500 angstroms and the copper core has 1–10 ppm oxygen and less than 1 ppm hydrogen, wherein the oxide layer further comprises cupric oxide layer and the cuprous oxide layer is disposed between the cupric oxide layer and the copper core.

2. The roughly drawn copper wire of claim 1, wherein the thickness of the cuprous oxide layer is 0.2 to 90% of the total thickness of the oxide layer.

3. The roughly drawn copper wire of claim 1, wherein the thickness of the cuprous oxide layer is 1 to 50% of the total thickness of the oxide layer.

4. The roughly drawn copper wire of claim 1, wherein the total thickness of the oxide layer is 150 to 500 angstroms.

5. The roughly drawn copper wire of claim 1, wherein the copper core has 1 to 8 ppm of oxygen.

6. The roughly drawn copper wire of claim 1, wherein the copper core has 0.5 pmm or less of hydrogen.

7. The roughly drawn copper wire of claim 1, wherein there is no clear boundary formed between cupric oxide and cuprous oxide in the oxide layer.

* * * * *